US006932360B2

(12) United States Patent
Wegener et al.

(10) Patent No.: US 6,932,360 B2
(45) Date of Patent: Aug. 23, 2005

(54) ADJUSTABLE FRAME ASSEMBLY FOR SKATES

(75) Inventors: Andreas C. Wegener, 3204 Rimo Rock Cir., Encinitas, CA (US) 92024; Steve B. Cook, Oceanside, CA (US)

(73) Assignee: Andreas C. Wegener, Encinitas, CA (US)

( * ) Notice: Subject to any disclaimer, the term of this patent is extended or adjusted under 35 U.S.C. 154(b) by 0 days.

(21) Appl. No.: 10/287,298

(22) Filed: Nov. 1, 2002

(65) Prior Publication Data

US 2004/0084861 A1 May 6, 2004

(51) Int. Cl.[7] ..... A63C 1/22

(52) U.S. Cl. ..... 280/11.16; 280/11.19; 280/11.221; 280/11.231; 280/11.26

(58) Field of Search ..... 280/11.3, 11.16, 280/11.19, 11.221, 11.231, 7.1, 7.13, 841, 11.223, 11.224, 11.26, 11.27, 11.31, 11.32, 11.233

(56) References Cited

U.S. PATENT DOCUMENTS

RE16,493 E * 11/1926 Carlson ..... 280/11.16
2,533,277 A * 12/1950 Miller ..... 280/11.27
2,904,342 A * 9/1959 Jones et al. ..... 280/11.16
5,046,746 A * 9/1991 Gierveld ..... 280/11.222
5,388,846 A * 2/1995 Gierveld ..... 280/11.223
5,397,141 A * 3/1995 Hoshizaki et al. ..... 280/11.3
5,437,466 A * 8/1995 Meibock et al. ..... 280/11.202
5,452,907 A * 9/1995 Meibock et al. ..... 280/11.231
5,503,412 A * 4/1996 Hill ..... 280/7.13
5,836,592 A * 11/1998 Chang ..... 280/11.26
RE35,993 E * 12/1998 Gierveld ..... 280/11.231
6,139,030 A * 10/2000 Meibock et al. ..... 280/11.221
6,142,490 A * 11/2000 Monroy et al. ..... 280/11.27
6,164,669 A * 12/2000 Svensson ..... 280/11.3
6,367,818 B2 * 4/2002 Meibock et al. ..... 280/11.221
6,572,121 B2 * 6/2003 Shih ..... 280/11.33
6,669,210 B2 * 12/2003 Chen ..... 280/11.16

* cited by examiner

*Primary Examiner*—Christopher P. Ellis
*Assistant Examiner*—Kelly E Campbell
(74) *Attorney, Agent, or Firm*—Gordon & Rees LLP

(57) ABSTRACT

An adjustable frame assembly for skates to allow for attachment of the frame in a number of positions along the length of the boot portion of the skate. The assembly comprises a skate foot bed containing two recessed portions each containing an opening flanked by ribs corresponding to ribs on a T-nut allowing the T-nut to rest in a variety of positions in the recessed portion. The T-nut further comprises a threaded opening for coupling to a fastener which attaches the frame to the base of the boot portion of the skate.

16 Claims, 2 Drawing Sheets

ADJUSTABLE FRAME ASSEMBLY FOR SKATES

FIELD OF THE INVENTION

The present invention relates generally to skates in which the gliding portion is attached to a frame assembly wherein the frame assembly can be readily adjusted and attached in a number of positions along the length of the boot portion of the skate.

BACKGROUND OF THE INVENTION

Skates are comprised of two main components, a shoe or boot portion and a base portion including a gliding portion, wheels or a blade, attached to a frame, the frame being designed to mediate attachment of the gliding portion to the base of the boot portion. Ice skates typically have a single blade that is an integral part of the frame. The integrated blade and frame attach directly to the base of the boot portion of the skate. Roller skates generally have two pairs of wheels, one pair in each the front and the back of the skate. Each pair of wheels may be attached to a separate frame or all four may be attached to a single frame. In-line skates generally have four or five wheels arranged one after the other in a single line in the running direction of the skate. The wheels are rotatably mounted on a single frame or chassis, and the frame can be attached to the sole of the shoe by fasteners or can be integrated into the sole of the shoe. An example of a skate of this type is described in my U.S. Pat. No. 6,029,983. Other examples are described in U.S. Pat. No. 5,411,278 of Wittman and U.S. Pat. No. 5,806,860 of Conte.

The frame is typically fixed in a single position on the bottom of the boot portion of the skate. Therefore, the weight of the skater is always in a fixed position over the frame and gliding portion of the skate. Some skates have been developed to allow for the adjustment of the frame relative to the boot. A family of patents issued to Meibock et al. including U.S. Pat. Nos. 5,848,796 and 6,254,110, teach a moveable frame that may be adjusted both laterally and longitudinally relative to the boot. The base of the boot portion of the skate contains an oversized cavity to receive a plate containing a threaded opening therethrough to receive a complementary threaded fastener which is sized to extend through the lower frame into the plate. Upon loosening of the fastener, the plate can move longitudinally and latitudinally in the cavity allowing the position of the frame to be adjusted. Upon tightening, the plate becomes fixed in a single position. One problem with this arrangement is that the frame may shift relative to the boot on impact.

Beniot (U.S. Pat. No. 5,890,723) teaches a frame comprising a housing designed to accept a wedge shaped element, the housing being attached to the bottom of a boot portion of a skate, and a variety of gliding elements attached to a wedge shaped adaptor for insertion into the housing. The wedge shaped adaptor is capable of cooperating with a corresponding housing on the sole of the boot portion of the skate. The gliding portion is secured to the boot by tightening of a lateral member to obtain linkage by a progressive wedging effect. Such a system allows for the use of interchangeable gliding elements and their attachment in a variety of positions relative to the length of the boot portion of the skate.

Gierveld (U.S. Pat. RE35,993) teaches a skate with a frame wherein the frame has slotted holes that are oriented either parallel or perpendicular to the running direction of the skate. Screw bolts extend from the bottom of the outer sole of the skate boot through the frame. The frame can be affixed into place using an adjusting ring with an eccentrically placed hole for the lateral positioning of the frame, wherein the ring is fixed in position by tightening the screw. Alternatively, the slotted hole may contain an edge zone with ribs extending transversely to the longitudinal direction of the hole to be used in conjunction with a positioning ring with complementary ribs, through which the screw bolt may extend. Upon tightening of the screw, the ribs are engaged. Thus, the frame is held in a fixed position longitudinally on the base of the boot portion of the skate.

SUMMARY OF THE INVENTION

The invention is an adjustable frame assembly for skates to allow the the frame to be fixed at a number of positions along the length of the boot. The assembly includes a foot bed of a boot portion of a skate, the foot bed having two recessed areas each with an elongated opening in the center, each opening being flanked by ribs that run perpendicular to the length or running direction of the skate. The assembly further includes a T-nut of the same width as the recess, the T-nut having a protrusion of a size to fit snugly in the elongated opening, the protrusion additionally containing a threaded opening and being flanked by ribs corresponding to those in the foot bed of the skate. The T-nut can be seated in a number of positions such that the ribs of the nut are engaged with the ribs in the foot bed and the protrusion is seated at a selected position in the elongated opening in the recess in the foot bed. The assembly further comprises a complementary threaded fastener for insertion through an opening in a frame for holding gliding portions, the fastener being appropriately sized to snugly fit the opening in the frame and to be mated to the T-nut. Upon tightening of the fastener, the T-nut becomes securely seated in a single position in the foot bed, securely attaching the frame in a single position to the boot portion of the skate.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
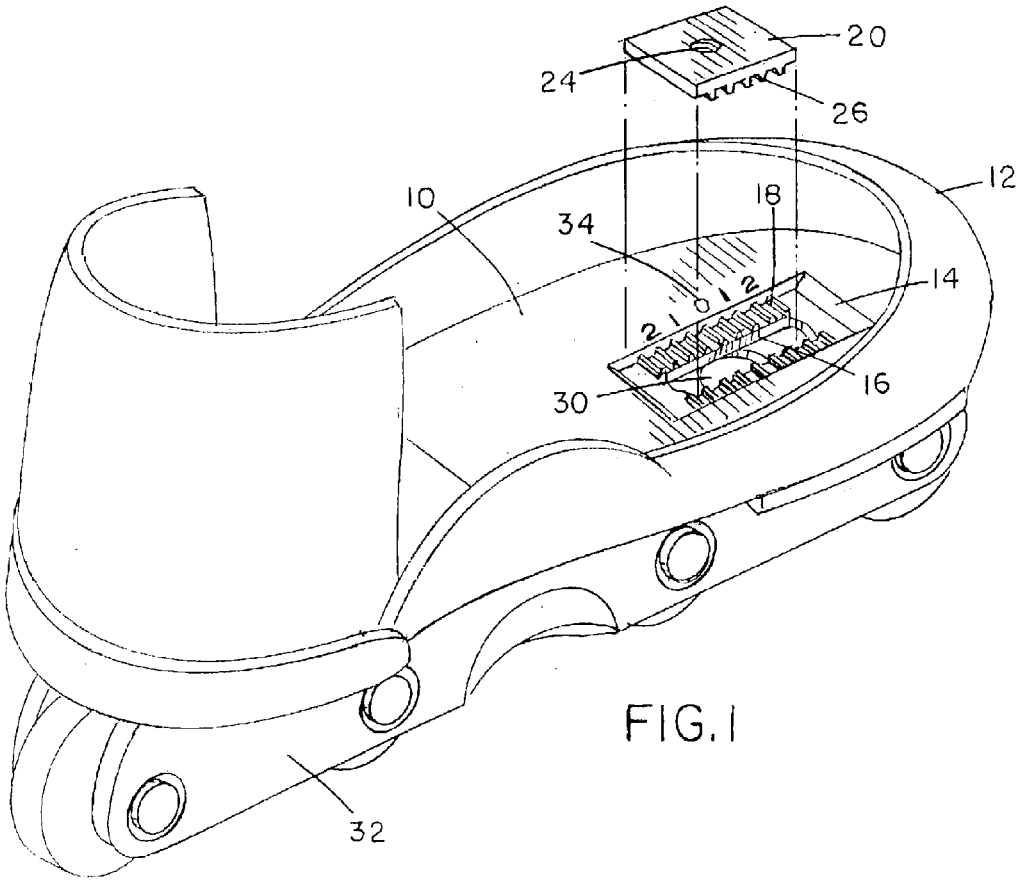
FIG. 1 is a perspective view of a typical skate boot incorporating an adjustable frame structure.
Figure 2:
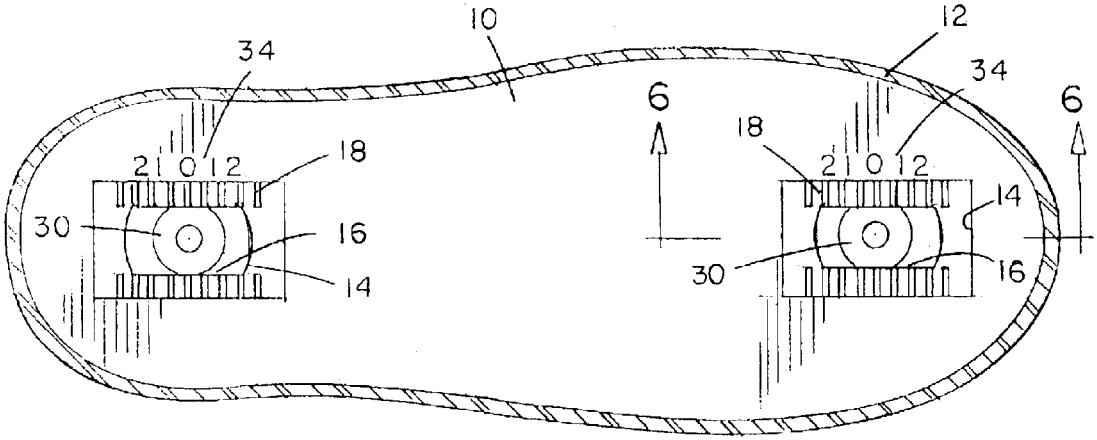
FIG. 2 is a top view of the sole portion with the peripheral structure cut away.
Figure 3:
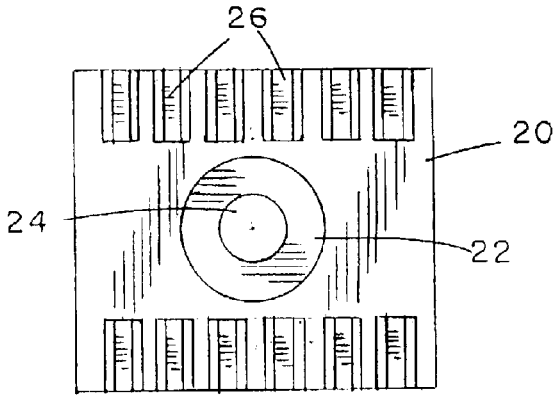
FIG. 3 is an enlarged bottom plan view of the nut plate.
Figure 4:
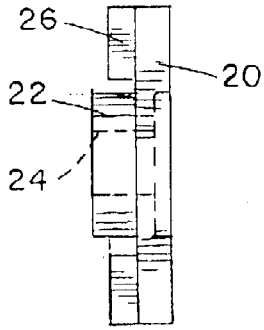
FIG. 4 is an end view of the nut plate.
Figure 5:
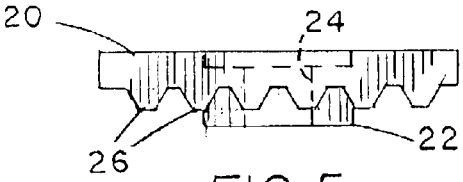
FIG. 5 is a side view of the nut plate.
Figure 6:
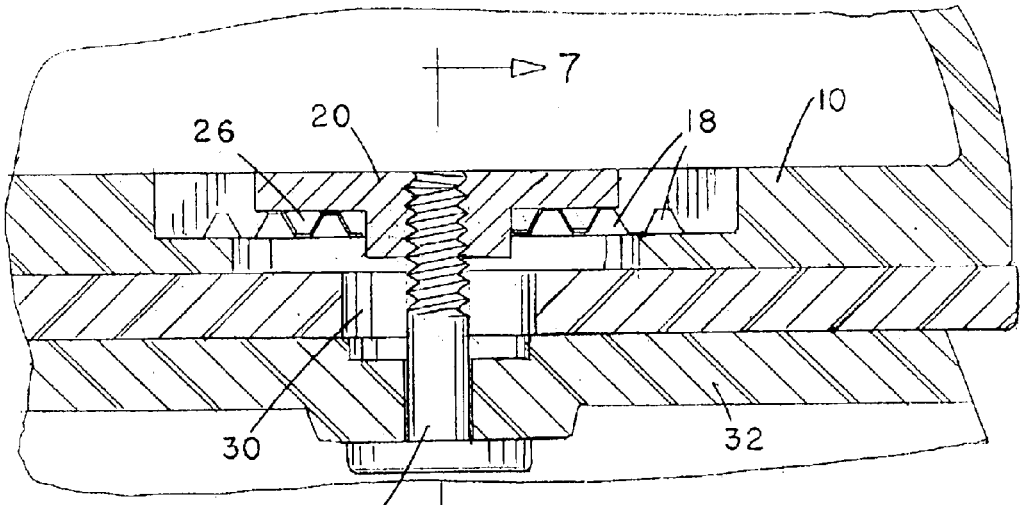
FIG. 6 is an enlarged sectional view taken on line 6—6 of FIG. 1.
Figure 7:
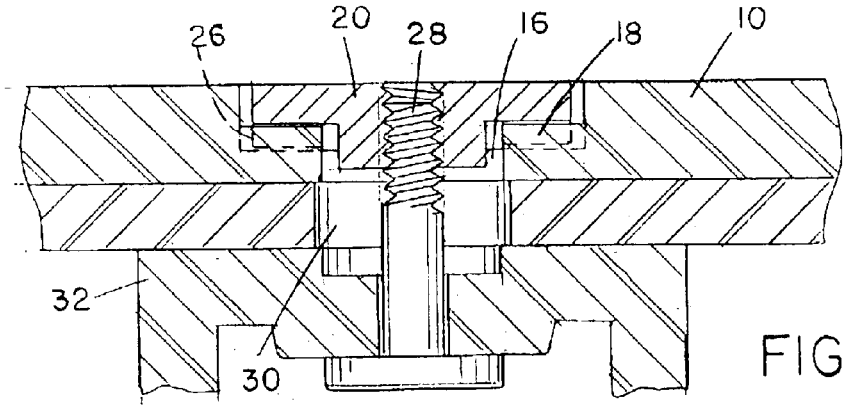
FIG. 7 is a sectional view taken on line 7—7 of FIG. 6.

The adjustable frame assembly of the invention includes a foot bed 10 of a boot portion 12 of a skate, the foot bed includes two, longitudinal spaced recessed areas 14 each with an elongated opening 16 in the center, the opening being flanked by ribs 18 that run perpendicular to the running direction of the skate, as best illustrated in FIGS. 1 and 2. The assembly further includes a pair of T-nuts 20 each of the same width as the respective recess 14, the T-nut including a protrusion 22 of a size to fit snugly in the elongated opening 16, the protrusion containing a threaded opening 24 and being flanked by ribs 26 corresponding to those in the foot bed of the skate. The T-nut can be seated in a number of positions such that the ribs of the nut are engaged with the ribs in the foot bed and the protrusion is seated in the elongated opening in the center of the recess in the foot bed. The assembly further comprises complementary threaded fasteners 28 for insertion through spaced openings 30 in the frame 32, the fasteners 28 being appropriately dimensioned for threaded engagement with threaded openings 24 of the T-nuts 20. Upon tightening of the screw, the T-nut becomes securely seated in a single position in the foot bed with the protrusion 22 of the T-nut seated in an opening 30 in the frame 32, securely attaching the frame 30 in a single position to the boot portion 10 of the skate.

The foot bed may optionally contain numbers or other markings 34 adjacent to the recess to facilitate the placement of the T-nuts in the same place in both skates. An edge or marking on the T-nut is aligned with the same marking or number on each boot. The relative position of frame and boot may be adjusted for the performance of tricks or other non-traditional forms of skating. The assembly of the invention can also be used to allow a number of frames of different lengths or with different gliding portions to be attached to a single boot portion. For example, the wheel base of a frame containing 5 wheels is typically longer than a frame with four wheels. It is far more economical to use one pair of boots on which the frames may readily be exchanged.

In an embodiment, the foot bed is overlaid by an insole with a rigid base to create a continuous surface for a softer insole to provide comfort and padding to the foot. Therefore, the irregularities in the foot bed of the boot will not be felt by the wearer. The rigid base and soft insole may be essentially the same shape and size as the foot bed. Alternatively, they may be incorporated into a soft boot that surrounds the foot completely.

The assembly of the instant invention provides a far more stable attachment of the frame to the boot than prior art adjustable frame assemblies. This assembly is sufficiently stable to allow the wearer to perform tricks or other maneuvers without shifting of the inner plate due to impact on the frame. The provision of making ribbed coupling surfaces on the inside of the boot, rather than on an external surface of the frame, avoids exposure to sand, dirt, water, etc. during use of the in line skates, typically outdoors. Thus, there is a reduced risk of damage or abrasion of the coupling, due to dirt or sand particles, which could reduce its strength.

The coupling between the T-nut and the boot of the instant invention occurs inside the boot, protecting it from potentially damaging agents. Due the the corresponding ribs on the foot bed and the T-nut, the frame cannot shift in relation to the boot. The snug fit of the protrusion in the elongated opening provides lateral stability of the frame on the boot. The provision of two spaced adjustable fasteners for longitudinal adjustment of the boot relative to the frame, such that the boot is clamped in its adjusted position at two spaced locations, further adds to stability. Therefore, the frame is attached securely to the boot in all directions. Moreover, the wearer's foot being contained within the boot portion of the skate provides pressure on the T-nut, further securing it in place.

Although an exemplary embodiment of the invention has been described above by way of example only, it will be understood by those skilled in the field that modifications may be made to the disclosed embodiment without departing from the scope of the invention, which is defined by the appended claims.

We claim:

1. An adjustable frame assembly for a skate comprising:

a boot portion of a skate wherein said boot portion includes a foot bed, said foot bed including a length, a width, a lower face, an inner face, a forward portion and a rear portion wherein the forward and rear portion of the foot bed each include a rectangular recessed portion in the inner face of the foot bed, said recessed portion having a length, a width and an elongated opening, said opening having long sides essentially parallel to the length of the foot bed, said openings being flanked by ribs running substantially perpendicular to the length of the opening;

a pair of T nuts, each T nut having an upper face and a lower face, said lower face including ribs corresponding to the ribs in a respective recessed portion of the foot bed, each T-nut being appropriately dimensioned to fit snugly in the width of a respective recessed portion, said lower face further including a protrusion appropriately dimensioned to fit snugly within the width of the elongated opening, said protrusion having a threaded opening therethrough;

a pair of screws, each screw being appropriately dimensioned to mate with the threaded opening of a respective T-nut; and a frame including a lower portion for attachment to a gliding portion and an upper portion for attachment to the lower face of the boot portion of a skate, said upper portion including generally round openings of predetermined cross-sectional dimensions slightly greater than the cross-sectional dimensions of the respective screws, whereby the screws are a snug fit in the respective openings, wherein upon tightening of each screw, the assembly is fixed at a single position on the foot bed of the boot portion of the skate.

2. The frame assembly of claim 1, wherein at least one recessed portion is flanked by markings for alignment of the T-nut in the ribs in the foot bed.

3. The frame assembly of claim 1, wherein each upper face of the T-nut is flat.

4. The frame assembly of claim 1, wherein each upper face of the T-nut is flush with the inner face of the foot bed when the ribs of the T-nut and foot bed are fully engaged.

5. The frame assembly of claim 1, wherein the gliding portion comprises wheels.

6. The frame assembly of claim 1, wherein the gliding portion comprises a blade.

7. The frame assembly of claim 1, wherein the foot bed is overlaid by a rigid insole.

8. The frame assembly of claim 7, wherein the rigid insole is overlaid by a padded insole.

9. An adjustable frame assembly for a skate, comprising:

a boot having a longitudinal axis in the direction of movement of the skate, and a sole portion, the sole portion having an upper surface and a lower surface;

a frame having an upper part for attachment to the lower surface of the sole portion and a lower part for attachment to a gliding assembly, the upper part of the frame having at least one generally round opening;

the upper surface of the sole portion having at least one recess of predetermined length and width, the recess having an elongate slot aligned with the longitudinal axis of the boot, and a series of transverse ribs extending transverse to the slot on opposite sides of the slot;

a nut for engagement in the recess having a head for fitting into the recess and a projection for extending into the slot, the head being of smaller dimensions than the recess at least in the longitudinal direction, whereby the head may be adjusted in position along the length of the recess, the head having a lower surface having a plurality of ribs for engagement with the ribs in the recess at a selected position in the recess for resisting further movement of the nut along the recess, and the nut having a threaded opening;

a screw fastener having a threaded shaft extending through the opening in the upper part of the frame and threadably engaging the threaded opening in the nut to lock the nut in a selected position in the recess, whereby the boot can be fixed in a selected position relative to the frame by tightening the screw fastener and may be adjusted in position by releasing the screw fastener; and the generally round opening in the upper part of the frame being of predetermined cross-sectional dimensions slightly greater than the cross-sectional dimensions of said threaded shaft, whereby the shaft is a snug fit in the opening.

10. The frame assembly of claim 9, wherein the recessed portion is flanked by markings for alignment of the nut in the ribs in the sole portion.

11. The frame assembly of claim 9, wherein the upper face of the nut is flat.

12. The frame assembly of claim 9, wherein the upper face of the nut is flush with the upper surface of the sole portion when the ribs of the nut and sole portion are fully engaged.

13. The frame assembly of claim 9, wherein the gliding portion comprises wheels.

14. The frame assembly of claim 9, wherein the gliding portion comprises a blade.

15. The frame assembly of claim 9, wherein the sole portion is overlaid by a rigid insole.

16. The frame assembly of claim 15, wherein the rigid insole is overlaid by a padded insole.

* * * * *